US009863047B2

(12) United States Patent
Yoshinaga et al.

(10) Patent No.: US 9,863,047 B2
(45) Date of Patent: Jan. 9, 2018

(54) ELECTROLYSIS DEVICE AND REFRIGERATOR

(71) Applicant: Kabushiki Kaisha Toshiba, Tokyo (JP)

(72) Inventors: Norihiro Yoshinaga, Kanagawa (JP); Yoshihiko Nakano, Kanagawa (JP); Norihiro Tomimatsu, Tokyo (JP); Yoshihiro Akasaka, Kanagawa (JP)

(73) Assignee: Toshiba Lifestyle Products & Services Corporation, Tokyo (JP)

( * ) Notice: Subject to any disclaimer, the term of this patent is extended or adjusted under 35 U.S.C. 154(b) by 547 days.

(21) Appl. No.: 14/453,895

(22) Filed: Aug. 7, 2014

(65) Prior Publication Data

US 2014/0339097 A1 Nov. 20, 2014

Related U.S. Application Data

(62) Division of application No. 13/408,234, filed on Feb. 29, 2012, now abandoned.

(30) Foreign Application Priority Data

Mar. 24, 2011 (JP) ..... 2011-065541

(51) Int. Cl.
*C25B 1/30* (2006.01)
*C25B 9/08* (2006.01)
(Continued)

(52) U.S. Cl.
CPC ..... *C25B 1/30* (2013.01); *C25B 9/10* (2013.01); *F25D 17/042* (2013.01); *F25D 2317/0411* (2013.01)

(58) Field of Classification Search
CPC . C25B 1/30; C25B 9/08; F25D 17/042; F25D 2317/0411
See application file for complete search history.

(56) References Cited

U.S. PATENT DOCUMENTS 6,179,986 B1 1/2001 Swette et al.
6,712,949 B2 * 3/2004 Gopal ..... C25B 1/30 204/263
(Continued)

FOREIGN PATENT DOCUMENTS

JP 56-33979 8/1981
JP 1-148327 6/1989
(Continued)

OTHER PUBLICATIONS

Decision issued by the Korean Intellectual Property Office on Oct. 14, 2015, for Korean Patent Application No. 2012-21777, and English-language translation thereof.
(Continued)

*Primary Examiner* — Ciel P Thomas
(74) *Attorney, Agent, or Firm* — Finnegan, Henderson, Farabow, Garrett & Dunner, L.L.P.

(57) ABSTRACT

An electrolysis device of an embodiment includes:
an anode, a cathode having a nitrogen-containing carbon alloy catalyst, and an electrolysis cell having a membrane electrode assembly composed of an electrolyte present between the anode and the cathode so that voltage is applied to the anode and the cathode, wherein the electrolyte is any one of acidic, neutral, or alkali, water is produced by the electrolysis device at the cathode, when the electrolyte is acidic, and hydroxide ion is produced by the electrolysis device at the anode, when the electrolyte is neutral or alkali.

24 Claims, 10 Drawing Sheets

(51) Int. Cl.
*F25D 17/04* (2006.01)
*C25B 9/10* (2006.01)

(56) References Cited

U.S. PATENT DOCUMENTS

| | | | | |
|---|---|---|---|---|
| 7,704,629 | B2 | 4/2010 | Lu et al. | |
| 2006/0263674 | A1 | 11/2006 | Hosoya et al. | |
| 2010/0323272 | A1 | 12/2010 | Ozaki et al. | |
| 2011/0114502 | A1* | 5/2011 | Cole | C25B 1/003 205/414 |
| 2011/0233071 | A1 | 9/2011 | Assmann et al. | |
| 2011/0243830 | A1* | 10/2011 | Ozaki | C01B 31/02 423/445 R |

FOREIGN PATENT DOCUMENTS

| | | | | |
|---|---|---|---|---|
| JP | 6-49129 | | 6/1994 | |
| JP | 2955938 | | 7/1999 | |
| JP | 2953464 | B | 9/1999 | |
| JP | 2001-149738 | A | 6/2001 | |
| JP | 3219610 | | 8/2001 | |
| JP | 2004-293827 | | 10/2004 | |
| JP | 2004-362802 | | 12/2004 | |
| JP | 2007-311026 | | 11/2007 | |
| JP | 2010-210170 | A | 9/2010 | |
| WO | WO 2009-093080 | A1 | 7/2009 | |
| WO | WO 2009/098812 | A1 | 8/2009 | |
| WO | WO 2010/069490 | A1 | 6/2010 | |
| WO | WO 2010064555 | A1 * | 6/2010 | C01B 31/02 |

OTHER PUBLICATIONS

Notification of the 2nd Office Action issued by the State Intellectual Property Office of the People's Republic of China dated Sep. 11, 2014, for Chinese Patent Application No. 201210053672, and English-language translation thereof.

Notice of Final Rejection issued by the Korean Intellectual Property Office dated Aug. 21, 2014, for Korean Patent Application No. 10-2012-21777, and English-language translation thereof.

Notification of Reason(s) for Refusal, issued by Japanese Patent Office, dated Jun. 17, 2014, for Japanese Patent Application No. 2011-065541, and English-language translation thereof (8 pages including translation).

Notification of the First Office Action issued by the State Intellectual Property Office of the People's Republic of China dated Jan. 30, 2014, for Chinese Patent Application No. 201210053672, and English-language translation thereof.

Liu et al., "Studies of oxygen reduction reaction active sites and stability of nitrogen-modified carbon composite catalysts for PEM fuel cells," Electrochimica Acta. Jan. 11, 2010.

Notification of Reason(s) for Refusal issued by the Japanese Patent Office dated Jul. 30, 2013, for Japanese Patent Application No. 2011-065541, and English-language translation thereof.

Notice of Preliminary Rejection issued by the Korean Intellectual Property Office dated Sep. 30, 2013, for Korean Patent Application No. 10-2012-21777, and English-language translation thereof.

Notice of Final Rejection, issued by Korean Intellectual Property Office, dated Apr. 28, 2014, in Korean Patent Application No. 10-2012-21777 (8 pages including translation).

Cooper, "In Situ PEM Fuel Cell Electrochemical Surface Area and Catalyst Utilization Measurement," Fuel Cell Magazine, Jan./Feb. 2009.

Notification of Reason(s) for Refusal issued by the Japanese Patent Office dated May 26, 2015, for Japanese Patent Application No. 2014-165935, and English-language translation thereof.

* cited by examiner

ELECTROLYSIS DEVICE AND REFRIGERATOR

CROSS-REFERENCE TO RELATED APPLICATION

This application is a division of application Ser. No. 13/408,234, filed Feb. 29, 2012, based upon and claims the benefit of priority from Japanese Patent Application No. 2011-065541, filed on Mar. 24, 2011; the entire contents of both of which are incorporated herein by reference.

FIELD

Embodiments described herein relate generally to an electrolysis device and a refrigerator.

BACKGROUND

Conventionally, a device utilizing an oxygen reduction reaction based on electrolysis is developed for use in a dehumidifying device, an oxygen concentration device, a de-oxygenation device, a salt electrolysis device, a gas sensor or a humidity sensor. For an anode of an electrolysis cell for performing the electrolysis, catalyst of platinum, lead, oxides, iridium composite oxide, or ruthenium composite oxide is used while a platinum based catalyst is used for a cathode.

However, for an oxygen reduction reaction, when the voltage applied to a cathode is higher than the theoretical voltage for generating hydrogen, hydrogen is generated at the cathode. For example, when a de-oxygenizing device is used for a refrigerator, a hydrogenation reaction occurs to lower power efficiency. This is due to the fact that Pt has a very high catalytic activity, and therefore easily causes a hydrogenation reaction accompanied with an oxygen reduction reaction. Further, lowering the voltage for electrolysis has a problem that a high electric current cannot be extracted, thus the deoxygenation efficiency is low.

DETAILED DESCRIPTION

Figure 1:
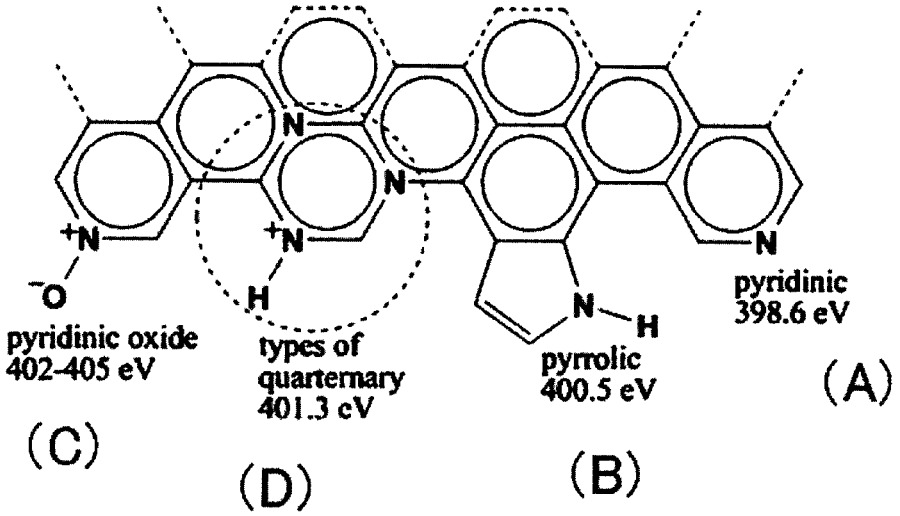
FIG. 1 illustrates an exemplary chemical structure of nitrogen-substituted carbon of an embodiment of the invention.

The electrolysis device of an embodiment includes an anode, a cathode having a nitrogen-containing carbon alloy catalyst, and an electrolysis cell having a membrane electrode assembly composed of an electrolyte present between the anode and the cathode so that voltage is applied to the anode and the cathode, wherein the electrolyte is any one of acidic, neutral, or alkali, water is produced by the electrolysis device at the cathode, when the electrolyte is acidic, and hydroxide ion is produced by the electrolysis device at the anode, when the electrolyte is neutral or alkali.

Embodiments of the invention will be described below with reference to the drawings.

The electrolysis device of an embodiment includes an anode, a cathode having a nitrogen-containing carbon alloy catalyst, and an electrolysis cell having a membrane electrode assembly composed of an electrolyte present between the anode and the cathode so that voltage is applied to the anode and the cathode.

The electrolysis device cell has a power source for applying voltage to an anode and a cathode so that electrolysis of water occurs at the cathode and the oxygen reduction occurs at the cathode by using the proton generated. In general, Pt is used as a catalyst for electrolytic oxygen reduction. However, in the cathode of the electrolysis cell of an embodiment of the invention, Pt having high oxygen reduction initiation potential is not included. When Pt is included in the cathode, the oxygen reduction reaction may easily occur as it has high oxygen reduction initiation potential. Specifically, based on the normal hydrogen electrode (NHE) potential, it is about 0.95 to 1.0 V vs. NHE compared to standard electrode potential for oxygen reduction of 1.23 V vs. NHE. However, since a cathode including Pt, which is also an excellent catalyst for generating hydrogen, has high hydrogen generation potential, a difference between the oxygen reduction initiation potential and hydrogen generation potential is small. As a result, hydrogenation reaction may also easily occur at the cathode. Specifically, when the standard hydrogen generation potential in acidic condition is 0 V vs. NHE, and the cathode is 0 V or less vs. NHE, hydrogen is immediately generated. Considering the use of an electrolysis cell of an embodiment of the invention other than a fuel cell, a high hydrogen-generating ability cannot be an advantage.

In case of a dehumidifying device or de-oxygenating device, etc., voltage is applied from the outside, and therefore when power consumption is above a certain level, a catalyst generating less hydrogen than the oxygen reducing performance at Pt level under electrolytic condition is advantageous. In particular, when potential of each electrode, i.e., an anode and a cathode, is not monitored, over-voltage ratio between each electrode cannot be easily known as it is determined by an activity of a catalyst or diffusion rate of materials at the anode and cathode. As a result, generation of hydrogen cannot be known from the voltage applied (i.e., applied voltage) only. For such case, a catalyst which hardly generates hydrogen can provide a high threshold application voltage, and therefore allows more efficient progress of the oxygen reduction reaction.

Carbon without any nitrogen (for example, Ketjen Black (registered trademark) or Vulcan (registered trademark) XC72R) has oxygen reduction initiation potential of 0.7 to 0.6 V vs. RHE, based on the reversible hydrogen electrode (RHE) potential, exhibiting not so high oxygen reducing ability. The hydrogen generation potential is about −0.1 to −0.2 V vs. RHE, indicating not so small hydrogen generating ability. Thus, the operative potential window ([oxygen reduction initiation potential]–[hydrogen generation potential]) is about 0.8 to 0.9 V, and both the oxygen reducing ability and hydrogen generating ability are not suitable for a catalyst for a cathode of an embodiment of the invention.

As a catalyst used for the cathode of the electrolysis cell of an embodiment of the invention, a catalyst which can cause the oxygen reduction at a relatively fast reaction rate and has a high activity of suppressing hydrogen generation is used.

The carbon alloy catalyst related to an embodiment of the invention is a compound having a group of carbon atoms as a main component, wherein a part of the carbon atoms is substituted with a nitrogen atom. The catalyst includes an amorphous or sp3 carbon as it overall has conductivity or high specific surface area. However, the nitrogen is included in the skeleton of sp2 carbon atom to substitute a carbon atom with a nitrogen atom in at least one form of a pyridine type (A), a pyrrole·pyridone type (B), an N oxide type (C), and a tri-coordinate type (D), as shown in the structure of FIG. 1. (A) to (D) of FIG. 1 represents an example of the substitution with nitrogen, and the structure of FIG. 1 does not indicate the carbon alloy catalyst itself of an embodiment of the invention.

The nitrogen substitution quantity in the carbon alloy catalyst of an embodiment of the invention is 0.1 atom % or more to 30 atom % or less compared to an amount of elements on surface in the carbon alloy catalyst. When the nitrogen substitution quantity is lower than the lower limit, an effect expected from nitrogen substitution is not enough, and therefore undesirable. On the other hand, when the nitrogen substitution quantity is higher than the upper limit, the structure is disrupted to lower conductivity, and therefore undesirable. Further, the nitrogen substitution quantity is more preferably in the range of 0.1 atom % or more to 10 atom % or less from the viewpoint of conductivity. When the carbon alloy catalyst is used as a catalyst for a cathode, hydrogen generation potential decreases depending on the nitrogen substitution quantity and operative potential window is more than 1 V, and therefore desirable. Specifically, the carbon alloy catalyst is observed to have an oxygen reduction initiation potential of 0.84 V vs. RHE, hydrogen oxidizing voltage of −0.46 V, and potential window of about 1.3 V, which is broader than that of Pt.

With regard to the definition of the carbon alloy catalyst as used herein, a part of carbons forming sp2 hybrid orbital is substituted with nitrogen is indicated.

In the carbon alloy catalyst of an embodiment of the invention, the number of active sites in the catalyst increases in accordance with an amount of carbon added with nitrogen. Further, as the carbon catalyst of an embodiment of the invention has more active sites contributing to oxygen reduction current as the surface area of the catalyst increases, the carbon catalyst with larger specific surface area is preferable.

Meanwhile, when the specific surface area of the carbon alloy catalyst is too large, ratio of fine pores with a diameter of 10 nm or less increases on the surface of the carbon alloy catalyst. Because such fine pores lower the diffusion rate of an oxygen gas required for oxygen reduction reaction to an extremely slow level, they are undesirable. Thus, it is preferable that the ratio of fine pores is small and most (60% or more) pores of the carbon alloy catalyst have a diameter of 20 nm or more. Based on the above, the specific surface area of the carbon alloy catalyst is from 100 $m^2/g$ or more to 1200 $m^2/g$ or less.

The substitution quantity of nitrogen atom indicates a ratio of carbon (C) to nitrogen (N), i.e., (C/N ratio), that can be measured by X-ray photoelectron spectroscopy (XPS). The C/N ratio can be calculated from the ratio of signal strength of carbon atom C1s near 290 eV and signal strength of nitrogen atom N1s near 400 eV. C/N ratio can be calculated by using a compound having definite composition ratio such as $C_3N_4$ as a reference material.

A sample for measurement can be produced by carving from a cathode of an electrolysis cell.

However, according to the measurement by XPS, a non-substituted nitrogen such as amine is also detected, in addition to the nitrogen which substitutes sp2 carbon. Thus, to exclude an effect of a non-substituted nitrogen, the sample prepared is calcined for 1 hour at 800° C. under argon atmosphere to dissociate a non-substituted nitrogen, and XPS measurement is carried out thereafter so as to remove an effect of a non-substituted nitrogen.

Herein, further classification of substitution type can be also made. By classifying the peaks of the signal of nitrogen atom N1s near 400 eV, classification into 398.5 eV—pyridine type, 400.5 eV—pyrrole·pyridone type, 401.2 eV—tricoordinate type, and 402.9 eV—N oxide type, and consequently the substitution type and quantity of nitrogen can be clearly determined.

In order to specify the nitrogen substitution quantity, it is useful that a sample produced in single-batch is divided into four portions considering non-uniformness during heating or mixing of a sample, and each is subjected to determination of a surface state by XPS. Such procedure is effective for checking the quality.

[Method for Producing Carbon Alloy Catalyst]

A method for producing the carbon alloy catalyst of an embodiment of the invention is exemplified below, but it is not limited thereto. The carbon alloy catalyst can be produced according to a method well known in the art including the method exemplified below.

A resin containing nitrogen and a compound containing metal are heat-treated under inert gas atmosphere (nitrogen and argon, etc.) for carbonization. The carbonized product is subjected to an acid treatment to give the carbon alloy catalyst of an embodiment of the invention.

A resin and a compound containing metal are heat-treated under nitrogen atmosphere for carbonization. The carbonized product is subjected to an acid treatment to give the carbon alloy catalyst of an embodiment of the invention. A resin containing metal can be also used instead of a resin and a compound containing metal.

According to nitrogen plasma treatment of carbon, the carbon alloy catalyst of an embodiment of the invention is produced.

According to chemical deposition of a material having a carbon source and a nitrogen source, the carbon alloy catalyst of an embodiment of the invention is produced.

Examples of the resin containing nitrogen include a phenol resin containing nitrogen, an imide resin, a melamine resin, a benzoguanamine rein, an epoxy acrylate resin, a urea resin, bismaleimide aniline, a benzoxazine resin, and the like.

Examples of the metal include iron, cobalt, and the like.

Examples of the compound containing metal include compounds such as iron phthalocyanine, cobalt phthalocyanine, iron sulfate, cobalt sulfate, iron chloride, cobalt chloride, cobalt sulfate, iron nitrate, potassium hexacyanoferrate, cobalt nitrate, and cobalt acetate.

Examples of the material containing a carbon source include methane, ethane, acetylene, ethylene, ethanol, methanol, and the like.

Examples of a target containing a nitrogen source include ammonia, nitrogen trifluoride, hydrazine, and the like.

Further, when the carbon alloy catalyst has low surface area or low conductivity, it is also possible that the catalyst is supported on a carrier or mixed with a carrier.

Examples of the support that can be used include commercially available carbon such as Ketjen Black, Vulcan XC72R, VGCF, etc., a carbonized organic matter containing carbon such as phenol, and a conductive oxide such as $RuO_2$ and $IrO_2$.

A method for mixing a resin containing nitrogen or a resin containing a metal and nitrogen and a metal or a compound containing a metal include a wet and a dry mixing method which uses a ball mill or a stirrer.

When nitrogen is introduced into carbon by carbonization, materials such as a resin are calcined under atmosphere of gas containing nitrogen. If there is no need to introduce nitrogen into carbon by carbonization, materials such as a resin can be calcined under the atmosphere of an inert gas. Temperature for carbonization is, for example, from 600° C. or more to 1200° C. or less, and the carbonization is carried out between several minutes and several hours.

Nitrogen can be also introduced into carbon by a nitrogen plasma treatment of carbon. Carbon can be further introduced by nitrogen plasma treatment of the carbon alloy catalyst.

Further, if a metal compound is present after production according to the above method, it is eliminated by a treatment with an acid. Types of the acid used for an acid treatment may vary depending on the metal to be used, but the examples thereof include hydrochloric acid, sulfuric acid, nitric acid, and the like.

As for the acid treatment, the examples include that immersion in a solution (0.1 to 10 M) diluted with pure water is carried out for 30 to 20 hours and filtration washing with pure water is repeated three times or more.

[Cathode]

Figure 2:
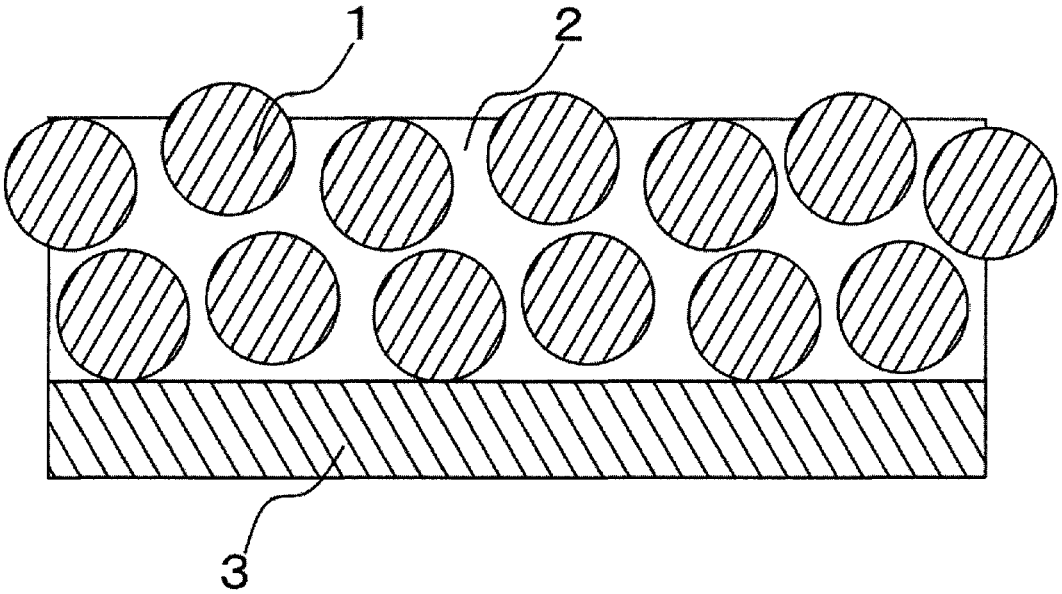
FIG. 2 is a conceptual diagram of a cathode of an embodiment of the invention.

The cathode of an embodiment of the invention is constituted with, as shown in the conceptual diagram of FIG. 2, the electrode support material 3 and the carbon alloy catalyst 1 fixed on the electrode support material 3 via the ion conducting binder 2. Constitution of the cathode is not specifically limited if the carbon alloy catalyst is fixed on the electrode support material.

When the carbon alloy catalyst of an embodiment of the invention is dispersed in a solvent to give a slurry and the slurry obtained is coated on an electrode support material followed by treatment such as drying or calcination, an electrode can be produced as a cathode. It is also possible that both the drying and calcination are carried out. It is preferable that, before or after calcination or drying, an ion conducting binder is added dropwise or coated. The ion conducting binder may be admixed with a slurry. Treatments of coating, drying and calcination can be repeated several times.

Further, in case of using an acidic electrolyte, it is preferable to use a proton conducting binder such as Nafion. In case of using neutral alkali electrolyte, it is preferable to use an alkali conducting binder.

Examples of the electrode support material include porous materials that are the same as the gas diffusion layer used for various electrolyte membranes and fuel cells, etc. (for example, a porous material such as carbon paper), titan mesh, SUS mesh, nickel mesh, and the like.

Examples of the solvent that is used for production of the slurry include those used for producing an electrode catalyst for a fuel cell, and the like. Specific examples thereof include, water, ethanol, isopropyl alcohol, butanol, toluene, xylene, methyl ethyl ketone, acetone, and the like.

As one of examples of the ion conducting binder, a fluorine-based or hydrocarbon-based ionomer as a proton conductor and an ionomer having an ammonium base as a hydroxide ion conductor are included. It is preferably dissolved in a solvent such as ethanol and used.

[Anode]

The anode of an embodiment of the invention can be produced by using a catalyst for anode and the same materials and method as used for producing the cathode. Examples of the catalyst used for an anode include platinum, lead oxide, iridium composite oxide, ruthenium composite oxide, and the like. Examples of a method for producing the catalyst include a pyrolysis, a sol-gel method, a complex polymerization, and the like.

Further, examples of the composite metal oxide include at least one of Ti, Nb, V, Cr, Mn, Co, Zn, Zr, Mo, Ta, W, Tl, Ru and Ir. Examples of the electrode support element for the catalyst include a valve metal such as Ta and Ti.

[Electrolyte]

Examples of an electrolyte that can be used in an embodiment of the invention include a liquid electrolyte, a cation exchange membrane, and an anion exchange membrane, and the like. Examples of the liquid electrolyte include sulfuric acid, nitric acid, hydrochloric acid, an aqueous solution of sodium hydroxide, an aqueous solution of potassium hydroxide, an aqueous solution of potassium chloride, and the like. Examples of the cation exchange membrane include Nafion 112, 115, 117, Flemion, Aciplex, Gore and Select. Examples of the anion exchange membrane include A201 (trade name, manufactured by Tokuyama Corp.). Further, a hydrocarbon-based membrane can also be used as an electrolyte.

[Electrolytic Reaction]

When an acidic material is used as an electrolyte, a reaction as follows (Reaction formula 1-2) occurs at an anode and a cathode, respectively, upon the application of voltage.

Anode $$2H_2O \rightarrow O_2 + 4H^+ + 4e^- \quad \text{(Reaction formula 1)}$$

Cathode $$O_2 + 4H^+ + 4e^- \rightarrow 2H_2O \quad \text{(Reaction formula 2)}$$

When oxygen supply is insufficient as surface of a cathode is covered with water, etc. and an applied voltage is greater than a certain value (hydrogen generating potential), the following reaction (Reaction formula 3) also occurs at the cathode.

$$2H^+ + 2e^- \rightarrow H_2 \quad \text{(Reaction formula 3)}$$

When a neutral or an alkali material is used as an electrolyte (electrolysis liquid), the following reaction (Reaction formula 4 and 5) occurs at an anode and cathode, respectively, upon the application of voltage.

Anode $$O_2 + 2H_2O + 4e^- \rightarrow 4OH^- \quad \text{(Reaction formula 4)}$$

Cathode $$4OH^- \rightarrow O_2 + 2H_2O + 4e^- \quad \text{(Reaction formula 5)}$$

When oxygen supply is insufficient as surface of a cathode is covered with water, etc. and an applied voltage is greater than a certain value (hydrogen generating potential), the following reaction (Reaction formula 6) also occurs at the cathode.

$$2OH^- \rightarrow O_2 + H_2 + 2e^- \quad \text{(Reaction formula 6)}$$

[Membrane Electrode Assembly]

Figure 3:
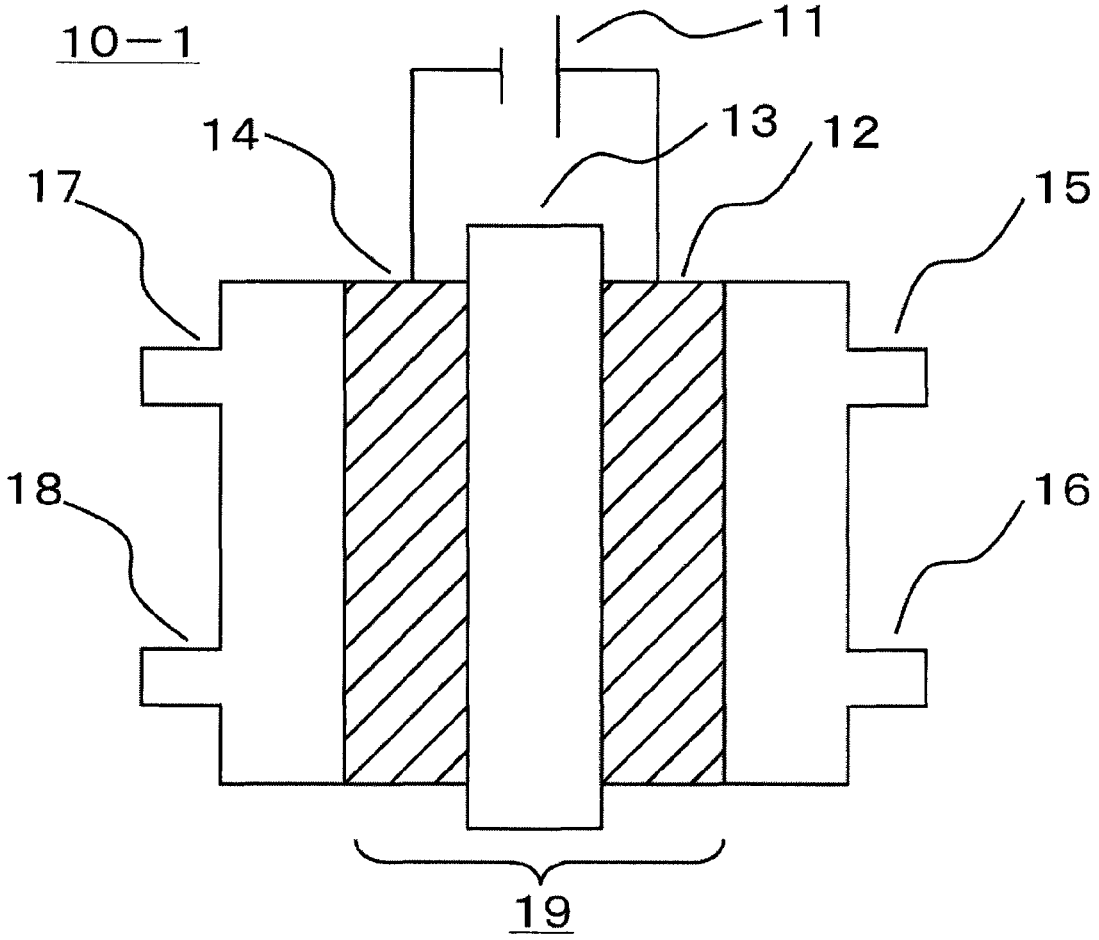
FIG. 3 is a conceptual diagram of an electrolytic device of an embodiment of the invention.

As shown in part of the electrolysis cell in the conceptual diagram of FIG. 3, the membrane electrode assembly 19 of an embodiment of the invention includes the solid polymer electrolyte 13 between the anode 12 and the cathode 14. Presence of the membrane electrode assembly 19 allows close contact between the two electrodes according to hot press or direct coating of the solid polymer electrolyte 2 on both surfaces thereof.

[Electrolysis Cell and Electrolysis Device]

The electrolysis device 10-1 of an embodiment of the invention has, as shown in the conceptual diagram of FIG. 3, the membrane electrode assembly 19 described above, an electrolysis cell consisting of the water supply tube 15, the water discharge tube 16, the air supply tube 17, and the air discharge tube 18, and the power source 11 (power source of direct current) which applies voltage to the two electrodes of the membrane electrode assembly 19. As the water supply tube 15, the water discharge 16, the air supply tube 17, and the air discharge tube 18 are the members for supplying a gas or water (aqueous solution) required for the reaction described above, they may have any constitution depending on types of an electrolyte or purpose and use of an electrolysis cell. The reaction is allowed to progress by applying voltage to the electrolysis cell.

The carbon alloy catalyst of an embodiment of the invention can be used as an oxygen reduction catalyst having an effect of suppressing hydrogen generation. Use of the catalyst is not limited to a deoxygenization element or a humidifying/dehumidifying element. It can be also used as a cathode for soda electrolysis, for example.

Figure 4:
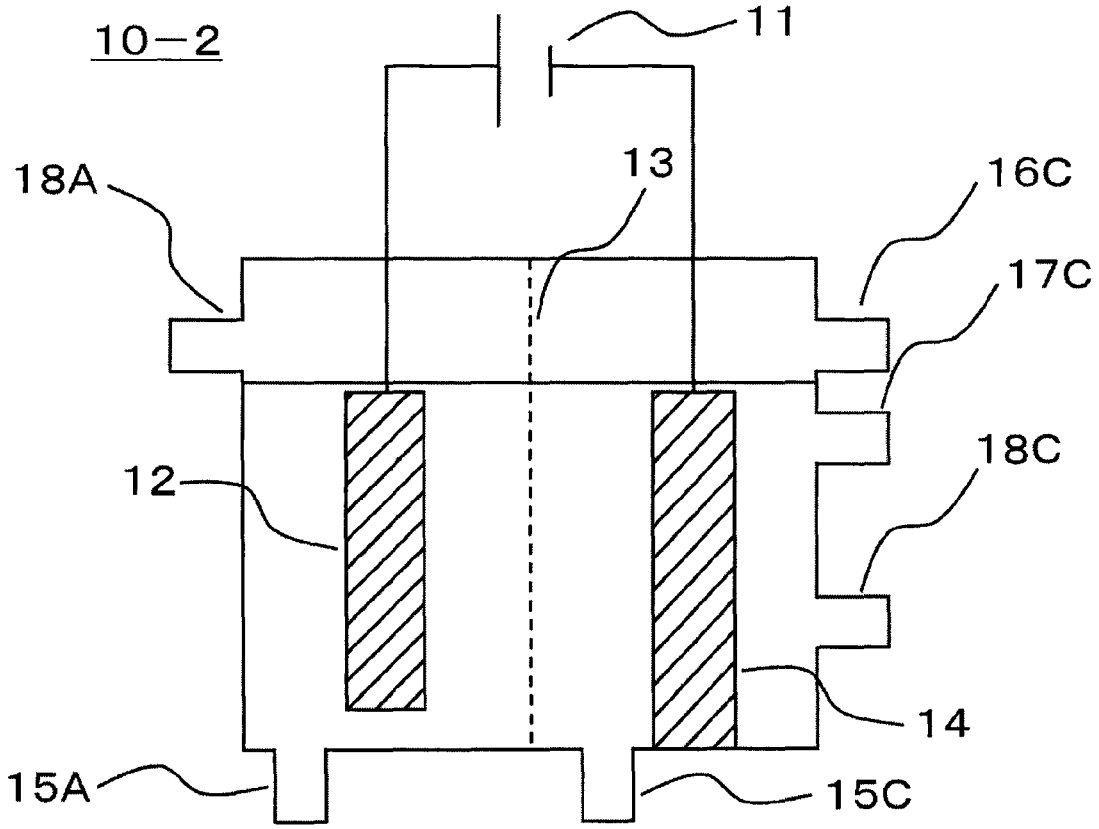
FIG. 4 is a conceptual diagram of a soda electrolysis device of an embodiment of the invention, wherein a gas diffusion electrode is included in the electrolysis device.

Further examples of the electrolysis device of an embodiment of the invention include the soda electrolysis device 10-2 shown in the conceptual diagram of FIG. 4 and a chlorine generation device. A slurry containing a mixture of the carbon alloy catalyst and a binder (PTFE) in ethanol is coated on a titan mesh, which is then calcined at 300° C. under Ar atmosphere to give a gas diffusion electrode, i.e., the cathode 14. For the anode 12, a carbon electrode, etc. is used and an aqueous solution of NaCl is used as an electrolysis liquid. The cathode 14 and the anode 12 are separated from each other by the ion exchange membrane 13. At the cathode side of the device shown in FIG. 4 has a constitution that oxygen or air is supplied from the gas supply tube 17C, water is supplied from the water supply tube 15C, caustic soda is discharged via the liquid discharge tube 16C, and gas is discharged via the gas discharge tube 18C. The anode side of the device shown in FIG. 4 has a constitution that an aqueous solution of sodium chloride is supplied from the liquid supply tube 15A and chlorine gas is discharged via the gas discharge tube 18A. When voltage is applied between the electrodes from the external power source 11 by using the device explained above, chlorine gas and sodium hydroxide are generated at the anode and the cathode, respectively. By using nitrogen-substituted carbon for such reaction, generation of hydrogen caused by application of high voltage can be suppressed more compared to a case in which other catalysts are used. It is also effective in that needs for having a device for treating hydrogen or a safety device is either lowered or eliminated or current extraction can be efficiently carried out even when an electrode potential is not monitored.

[Electrolysis Device Having Membrane Electrode Assembly]

By having a membrane electrode assembly connected with a power supply of an embodiment of the invention in a vessel, an oxygen reduction device, an oxygen concentration device, a humidifying device or a dehumidifying element can be provided.

Figure 5:
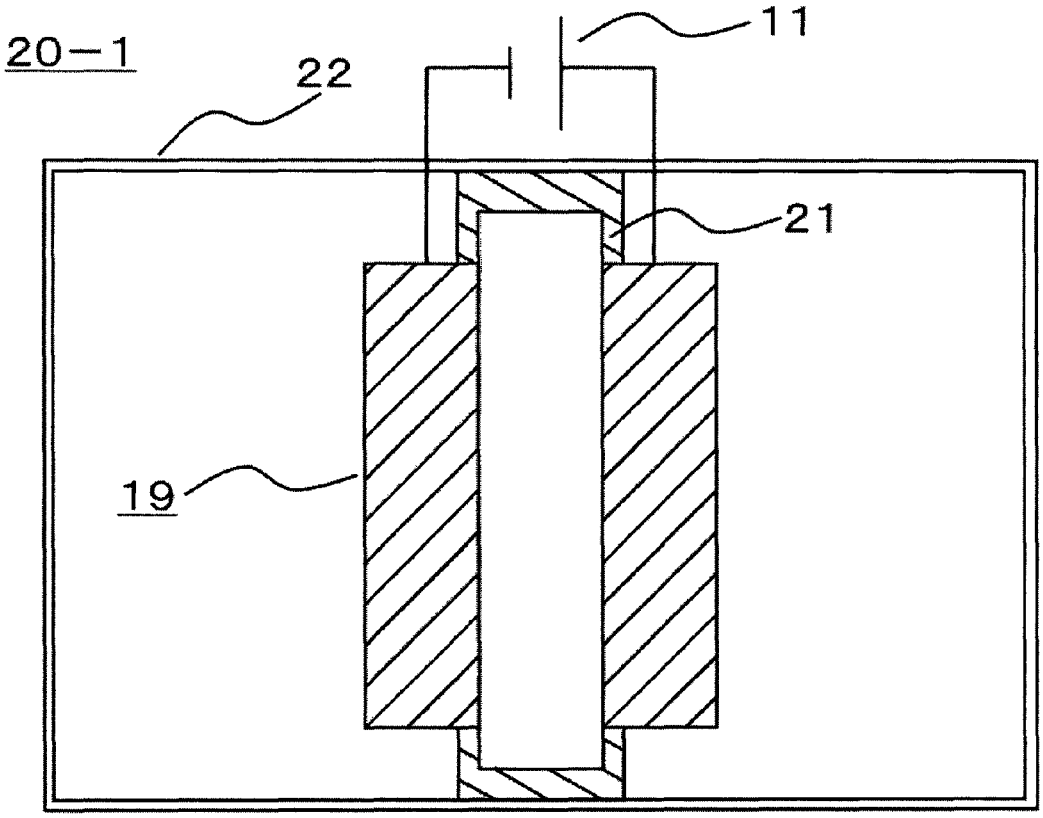
FIG. 5 is a conceptual diagram of a device having the electrolysis device of an embodiment of the invention.
Figure 6:
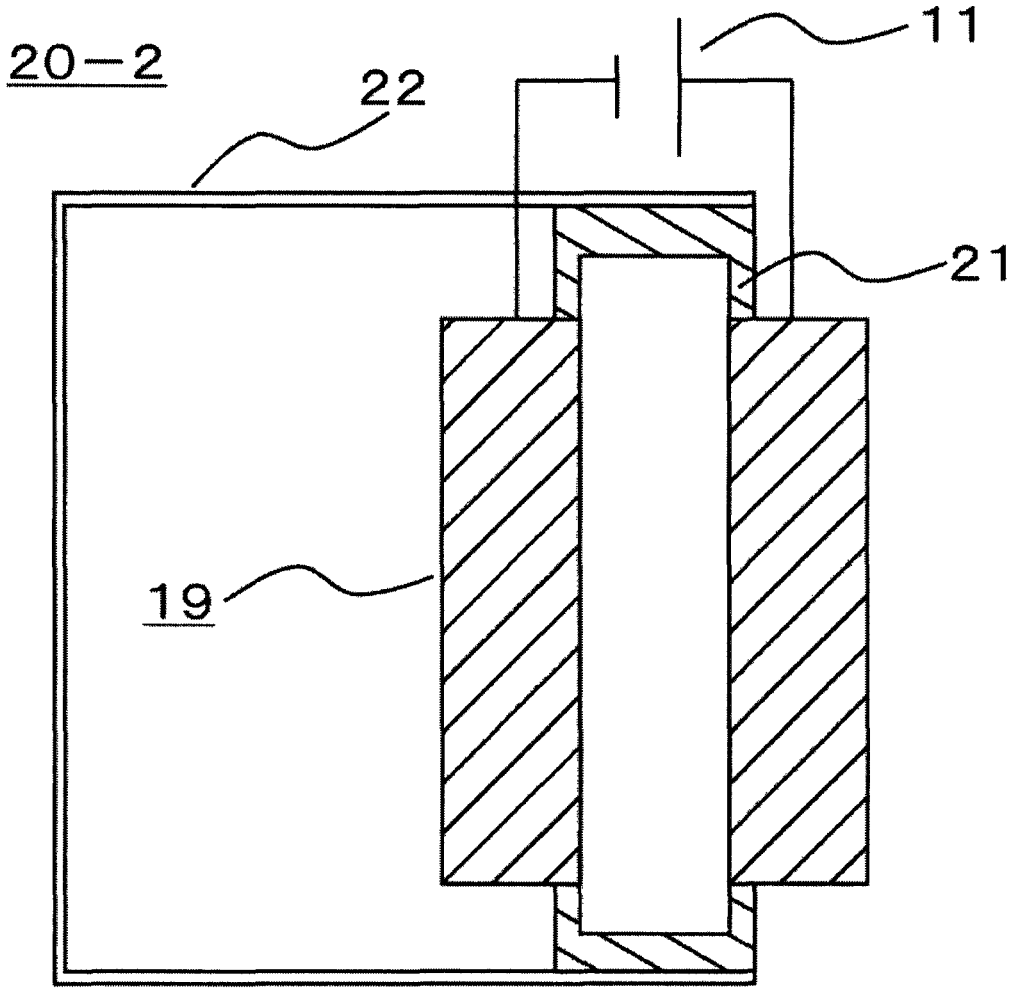
FIG. 6 is a conceptual diagram of a device having the electrolysis device of an embodiment of the invention.

As shown in the conceptual diagram in FIG. 5, in the device 20-1 the membrane electrode assembly 19 is fixed so as to divide a space within the vessel 22 to an anode side and a cathode side of the membrane electrode assembly 19. It has a constitution that the power supply 11 is connected to the membrane electrode assembly 19 and voltage is applied to both electrodes of the membrane electrode assembly. Fixing of the membrane electrode assembly is secured by the sealing agent 21 which separates the reaction space of one electrode from that of the other electrode. Further, as shown in the conceptual diagram of the device 20-2 in FIG. 6, the vessel 22 may be attached on the anode side or the cathode side of the membrane electrode assembly. In the device 20-1 and device 20-2, it is also possible that the vessel 22 and the membrane electrode assembly 19 may be semi-fixed so that they can be detached later.

According to a membrane electrode assembly which uses an acidic electrolyte, a reaction of dissociating water into oxygen and proton occurs in a space on an anode side, and therefore it can function as a device for concentrating oxygen or a dehumidifier. Meanwhile, in a space on a cathode side of an electrolysis cell which uses an acidic electrolyte, a reaction of producing water from oxygen and proton generating from an anode occurs, and therefore it can function as a device for reducing oxygen or a humidifier. Meanwhile, when a neutral or alkali electrolyte is used, water is consumed at an anode while it is newly generated at a cathode, showing an opposite function to the case in which an acidic electrolyte is used. For a device intended for humidification or dehumidification, it is also possible that the vessel 22 is used as either a water supply vessel or a water reservoir vessel, etc.

Figure 7:
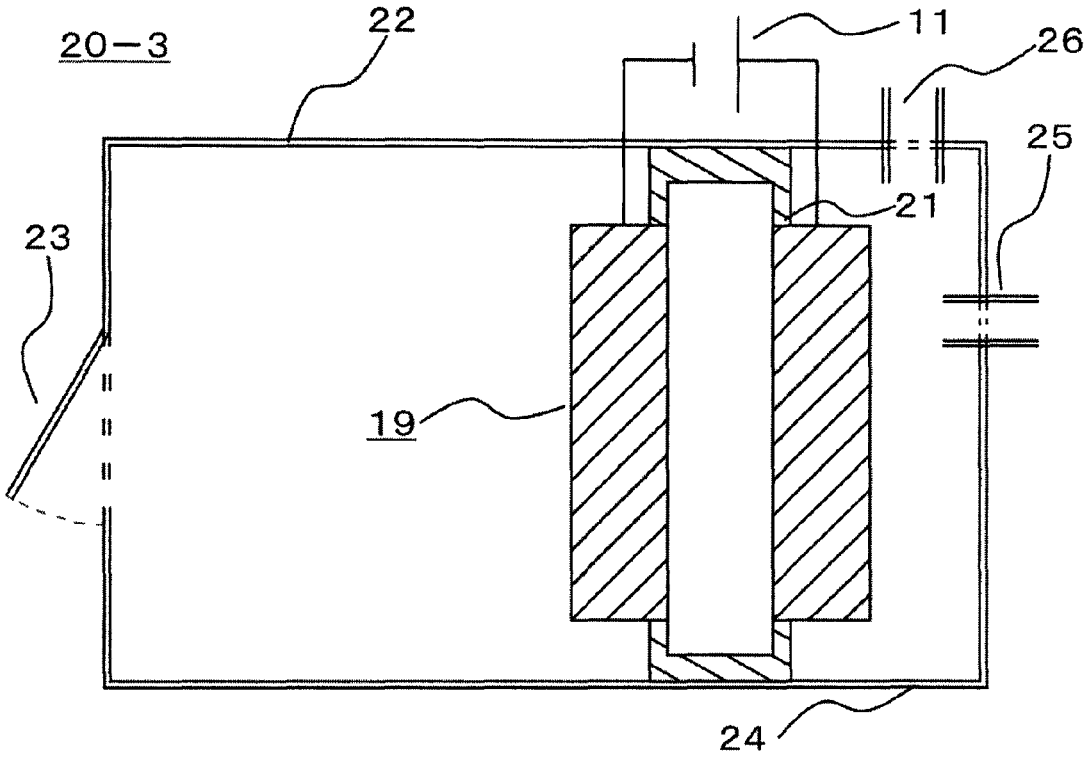
FIG. 7 is a conceptual diagram of a deoxygenation device of an embodiment of the invention.

In FIG. 7, a conceptual diagram of the oxygen reduction device 20-3 using the membrane electrode assembly is shown. Electrolyte of the oxygen reduction device 20-3 is acidic. In the oxygen reduction device 20-3, the vessel 22 is fixed on the cathode side and the water tank 24 is fixed on the anode side of the membrane electrode assembly 19, both fixed by the sealing agent 21. The vessel 22 also has the door 23 for charging and discharging any material under reduced oxygen condition. The water tank 24 has the water supply tube 25 and the oxygen discharge tube 26.

The vessel 22 may also have a door for introducing or removing materials or a member such as an air suction tube, an air discharge tube, a water supply tube, or a water discharge tube for charging and discharging gas, liquid or other materials, etc. Such door and tube may have any shape or function depending on purpose and use of a device.

In addition, a device having the membrane electrode assembly can be controlled to perform any operation of oxygen reduction, oxygen concentration, humidification, and dehumidification by switching between intake and discharge of gas, supply and discharge of water, or open and close of a sealed area with an aid of a controlling part which is not illustrated in the drawing. It is also possible that, by having an oximeter or a hygrometer, the effect obtained from operating device is easily identified. Further, it can be controlled to have any oxygen concentration or humidity. The control can be achieved either by electronic control using a microcomputer or a programmable IC such as FPGA (Field-Programmable Gate Array) or by manual control.

[Refrigerator Having Oxygen Reduction Device]

Figure 8:
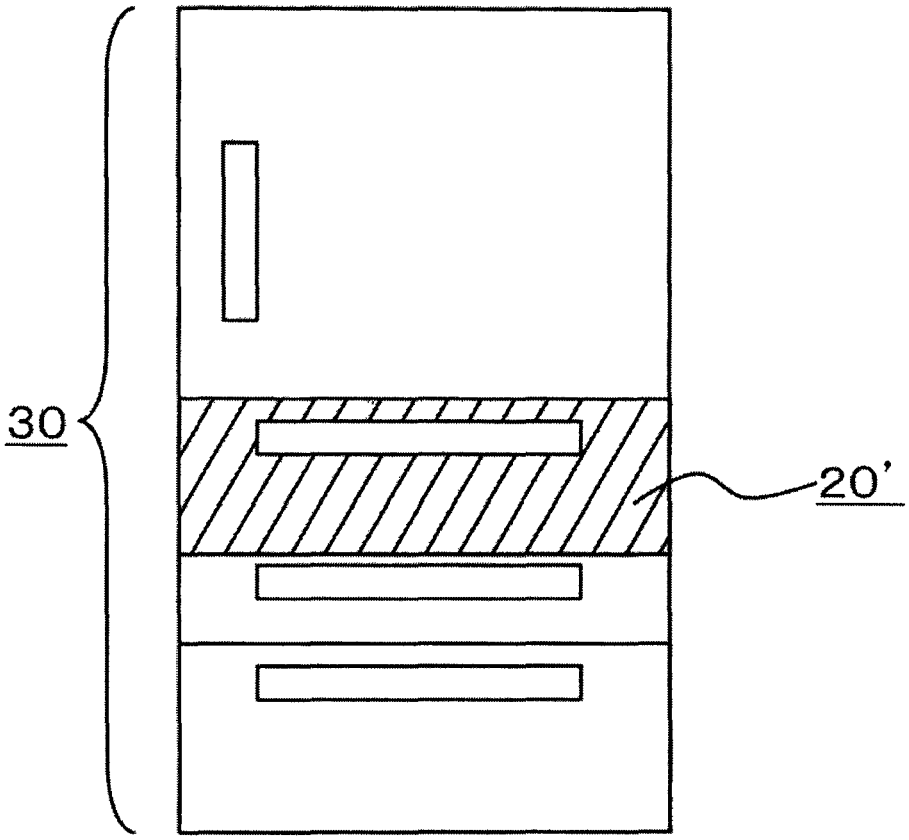
FIG. 8 is a conceptual diagram of a refrigerator of an embodiment of the invention.

FIG. 8 is a conceptual diagram of the refrigerator 30 in which the device 20' having the membrane electrode assembly is included. When oxygen is to be reduced, the device 20' having the membrane electrode assembly may have an embodiment that the door 23 of the oxygen reduction device 20-3 of FIG. 8 is provided as a refrigerator door. For reducing oxygen, although one room of the refrigerator 30 of FIG. 8 serves as an oxygen reduction device, the oxygen reduction device may be disposed at part of the room or it may be disposed at any location within the refrigerator. When oxygen reducing function is performed within a space for storing fresh food, food oxidation can be suppressed. In the refrigerator 30, instead of the device 20' having the membrane electrode assembly, a humidifying device or a dehumidifying device having the membrane electrode assembly can be also used.

In addition, instead of the oxygen reduction device 20', a controllable device to perform any operation of oxygen reduction, humidification, and dehumidification by switching between intake and discharge of gas, supply and discharge of water, or open and close of a sealed area with an aid of a controlling part which is not illustrated in the drawing can be included. It is also possible that, by having an oximeter or a hygrometer, the effect obtained from operating device is easily identified. Further, it can be controlled to have any oxygen concentration or humidity. The control can be achieved either by electronic control using a microcomputer or a programmable IC such as FPGA (Field-Programmable Gate Array) or by manual control.

[Test for Measuring Electrode Activity in Relation with Oxygen Reduction and Hydrogen Generation]

As a method of evaluating characteristics of the catalyst for reducing oxygen and generating hydrogen, potential sweep of an electrode is considered as a convenient method. By using the cell of a triode rotating ring disc electrode shown in the conceptual diagram of FIG. 9, activity of an electrode in terms of oxygen reduction and hydrogen generation is measured by potential sweep. Specifically, at the center of FIG. 9, the operating electrode 41 is present and a reference electrode (Ag/AgCl) 42 and the opposite electrode (carbon felt) 43 are present on the left side and the right side of the drawing, respectively. Regarding the operating electrode 41, a disc electrode consisting of glass fiber is formed in the middle part and the periphery of the disc electrode is added with a catalyst which is obtained by coating, calcining, and drying of the catalyst ink described above. The catalyst is covered with a polymer insulator, and the periphery of the catalyst is covered with an Au ring electrode. Further, the periphery of the ring electrode is covered with a polymer insulator. As for the electrolysis liquid 44, an acidic aqueous solution (0.5 M $H_2SO_4$ aq.) or an alkaline aqueous solution (0.1 M KOH aq.) purged with nitrogen or oxygen was used.

Figure 9:
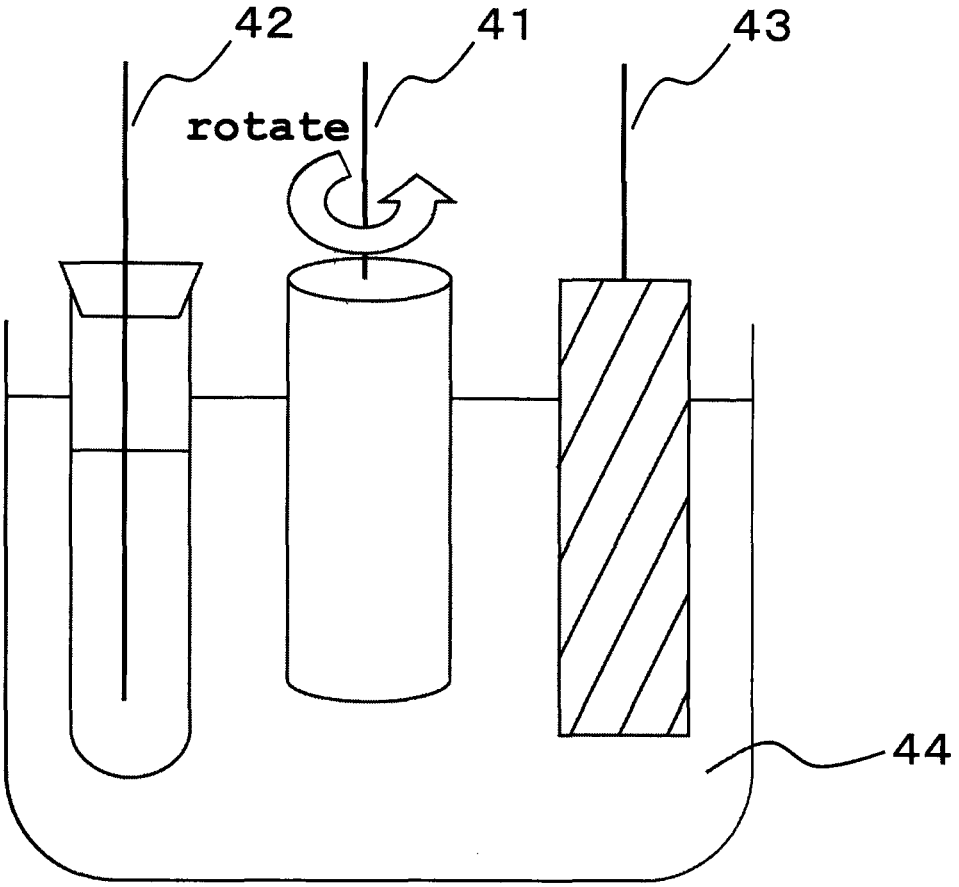
FIG. 9 is a conceptual diagram of a cell of a triode rotating ring disc electrode of an embodiment of the invention.

With the device shown in the schematic drawing of FIG. 9, the potential sweep is carried out at 10 mV/s by using a potentiostat. The revolution number was fixed at 2000 rpm and the potential range was 1.2 to −0.7 V vs. RHE.

(1) Oxidation Reduction Initiation Potential

From the voltammogram obtained by the potential sweep using an electrolyte purged with nitrogen and oxygen for measuring electrode activity, a difference is obtained, and the potential causing the first appearance of a negative current is taken as an oxygen reduction initiation potential.

(2) Hydrogen Generation Initiation Potential

Due to the generation of hydrogen from an electrolyte purged with nitrogen and occurrence of hydrogen adsorption current, etc., exact potential for initiating the hydrogen generation cannot be measured. For such reasons, a potential allowing a current of −5 mA/cm$^2$ or more under standard electrode potential is taken as a hydrogen generation initiation potential.

(3) Production Ratio of Hydrogen Peroxide

In case of an acidic electrolysis liquid, the reaction of the Reaction formula 2 may stop in the middle of the reaction and hydrogen peroxide may be produced instead of water according to the reaction of the Reaction formula 7. Thus, voltage is applied to the gold electrode 27 of the operating electrode 21 so as to cause the reaction of the Reaction formula 8, and as a result production ratio of hydrogen peroxide is obtained in view of the reaction current therefor.

Similarly, in case of a neutral alkaline electrolysis liquid, the reaction of the Reaction formula 5 may stop in the middle of the reaction and hydrogen peroxide may be produced instead of water according to the reaction of the Reaction formula 9. Thus, by allowing the reaction of the Reaction formula 10, the production ratio of hydrogen peroxide is obtained in a similar manner.

$$O_2+2H^++2e^-\rightarrow H_2O_2 \quad \text{(Reaction formula 7)}$$

$$H_2O_2\rightarrow O_2+2H^++2e^- \quad \text{(Reaction formula 8)}$$

$$1.5O_2+H_2O+2e^-\rightarrow 2HO_2^- \quad \text{(Reaction formula 9)}$$

$$2HO_2^-\rightarrow 1.5O_2+H_2O+2e^- \quad \text{(Reaction formula 10)}$$

Specifically, 1.2 V vs RHE is applied to the gold ring electrode, and the production ratio of hydrogen peroxide is obtained from an electric current value during potential sweep.

Formula for obtaining the production ratio of hydrogen peroxide, i.e., x, is as follows (Formula 1).

$$x=\frac{2I_R/N}{I_D+I_R/N}\times 100 \quad \text{Formula 1}$$

x: Hydrogen peroxide production ratio (%)

$I_R$: Ring current (A)

$I_D$: Disc current (A)

N: Collection Efficiency (−)

Further, the collection efficiency (N) is defined as the ratio between the absolute values of the ring current and disc current, and it was found to be N=0.4 for this case.

The collection efficiency (N) was calculated according to the following formula (Formula 2).

$$N=|I_D|/|I_R| \quad \text{Formula 2}$$

Herein below, the electrolysis cell, device, and refrigerator of an embodiment of the invention are more specifically explained with reference to the Examples.

Detection of hydrogen generation based on MEA was made in view of the hydrogen concentration in a gas discharged by a pump and the hydrogen concentration in a sealed vessel, which are measured by using a hydrogen gas detector.

Further, the theoretical oxygen consumption amount ($N_{O2}$) was calculated from the following formula (Formula 3).

$$N_{O2} = \frac{I}{n \cdot F} \times 22.4 \times \frac{T}{298.15} \times 60 \quad \text{Formula 3}$$

$N_{O2}$: Theoretical oxygen consumption amount (CCM)
I: Applied current (A)
n: Number of electrons reacted
F: Faraday constant
T: Temperature(K)

EXAMPLE 1

Figure 10:
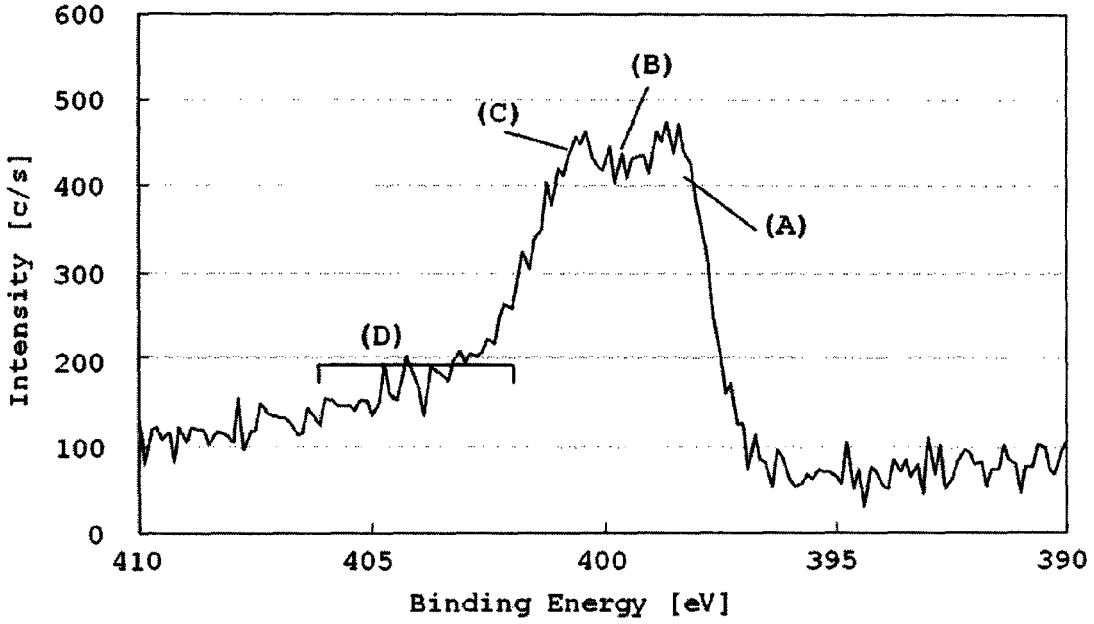
FIG. 10 is a graph illustrating the XPS measurement result of Example 1.
Figure 11:
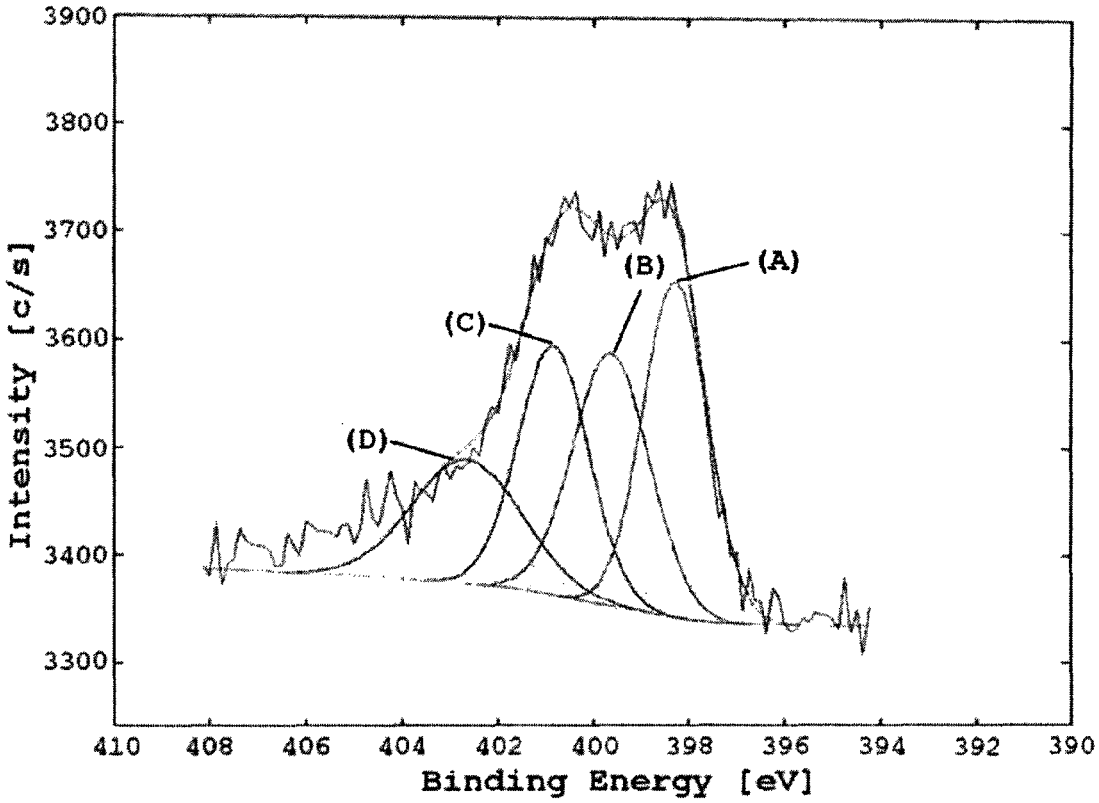
FIG. 11 is a graph illustrating the XPS measurement result of Example 1.

8 g of benzoguanamine resin containing nitrogen, 1 g of ferric chloride, and 5 g of KetjenBlack (registered trademark) EC300J as a carrier are mixed with 150 ml of THF (tetrahydrofuran). After mixing, the mixture was refluxed for 2 hours at 80° C. while being stirred at 300 rpm using a stirrer. The solution obtained after reflux was dried by an evaporator using a hot-water bath at 45° C., and the dried product was calcined for an hour at 800° C. under argon atmosphere. After calcination, the calcined product was washed with 2 M hydrochloric acid to give the carbon alloy catalyst. The sample produced was added in a stainless pan (diameter 1 mm, depth 30 μm) and the element analysis of the catalyst surface was carried out by XPS (trade name: QUANTUM-200, manufactured by PHI, X ray source/power output/range of analysis: single crystal spectrophotometric AlKα ray/40 W/φ200 μm). With a measurement at four points, it was confirmed that the nitrogen substitution quantity is from 1.3 to 1.8%. The N1s spectrum (one sample among the four samples measured) obtained was shown in FIG. 10. Since FIG. 10 includes at least the pyridine type (A), the pyrrole·pyridone type (B), the N oxide type (C), and the tri-coordinate type (D), the resolved peaks are shown in FIG. 11. As a result of the peak resolution, it was found that the pyridine type (A) has the highest intensity (FIG. 11).

To 1 ml of a dispersion medium adjusted to have water and ethanol at 1:1 ratio in terms of weight, 10 mg of the carbon alloy catalyst produced was added. The dispersion medium added with the carbon alloy catalyst was dispersed for 30 min by ultrasonication to produce a catalyst ink. 1 μl of the catalyst ink was collected using a micro pipette, and added dropwise to glassy carbon (registered trade mark) with Φ of 3 mm followed by drying in an incubator at 60° C. for 30 min. After drying, 3 μl of 0.05 wt % Nafion (registered trademark) ionomer was added dropwise thereto. After drying again, an operating electrode was produced.

By using the operating electrode produced, an electrode activity test regarding oxygen reduction and hydrogen generation was performed. Further, unless specifically described otherwise, the electrode activity test was performed with the conditions described above.

Regarding the electrode activity test of Example 1, the electrolysis liquid used was 0.5 M aqueous solution of sulfuric acid and the sweep rate was 10 mV/s.

From the measurement results, it was found that the oxygen reduction initiation potential is about 0.84 V vs. RHE in Example 1. The hydrogen generation initiation potential is −0.46 V vs. RHE. The operative potential window from the oxygen reduction to hydrogen generation is 1.3 V. The hydrogen peroxide production ratio is from 2 to 50%.

COMPARATIVE EXAMPLE 1

Except that the electrode activity test is carried out with an electrode which uses Pt/C (trade name: TEK10E70TPM, manufactured by TANAKA KIKINZOKU) instead of the carbon alloy catalyst as a catalyst, it is the same as in Example 1.

From the measurement results, it was found that the oxygen reduction initiation potential is about 0.98 V vs. RHE in Comparative Example 1. The hydrogen generation initiation potential is −0.012 V vs. RHE. The operative potential window from the oxygen reduction to hydrogen generation is 0.992 V. The hydrogen peroxide production ratio is from 2 to 15%.

When the carbon alloy catalyst of Example 1 is used instead of Pt of Comparative Example 1, it was found that the oxygen reduction initiation potential is low but the hydrogen generation initiation potential is even lower and hydrogen generation is suppressed. Further, the range from the oxygen reduction initiation potential to the hydrogen generation initiation potential, i.e., the range in which only oxygen reduction occurs, is broadened compared to the case in which Pt is used as a catalyst as in Comparative Example 1. For such reasons, a membrane electrode assembly wherein the carbon alloy catalyst of Example 1 is used as a catalyst of a cathode can be applied with higher voltage than a membrane electrode assembly wherein Pt is used as a catalyst, and it has a potential of allowing high electric current while suppressing hydrogen generation.

COMPARATIVE EXAMPLE 2

Except that the electrode activity test is carried out with an electrode which uses carbon containing no nitrogen (KetjenBlack (registered trademark) EC300J) instead of the carbon alloy catalyst as a catalyst, it is the same as in Example 1.

It was found that the oxygen reduction initiation potential is about 0.7 V vs. RHE in Comparative Example 2. The hydrogen generation initiation potential is −0.07 V vs. RHE. The operative potential window from the oxygen reduction to hydrogen generation is 0.77 V. The hydrogen peroxide production ratio is from 50 to 100%. Thus, it is found that the carbon alloy catalyst is essential for a cathode for a reaction of reducing oxygen to water.

EXAMPLE 2

In Example 2, the electrode activity test was carried out by using an alkali solution as an electrolysis liquid. Except that the electrode is prepared without using an ionomer for producing an operating electrode and 0.1 M aqueous KOH solution is used as an electrolysis liquid, it is the same as in Example 1. As the electrode was prepared without using an ionomer, the operating electrode was carefully immersed to avoid any loss of the catalyst. As the amplitude of the cyclic voltammogram does not change before and after the test for evaluating electrode activity, it was believed that the catalyst is not released in the electrolysis liquid.

The oxygen reduction initiation potential is about 0.95 V vs. RHE in Example 2. The hydrogen generation initiation potential is −0.61 V vs. RHE. The operative potential window from the oxygen reduction to hydrogen generation is 1.56 V. The hydrogen peroxide production ratio is from 2 to 50%.

COMPARATIVE EXAMPLE 3

Except that the electrode activity test is carried out with an electrode which uses Pt/C (trade name: TEK10E70TPM, manufactured by TANAKA KIKINZOKU) instead of the carbon alloy catalyst as a catalyst, it is the same as in Example 2.

The oxygen reduction initiation potential is about 0.99 V vs. RHE in Comparative Example 3. The hydrogen generation initiation potential is −0.096 V vs. RHE. The operative potential window from the oxygen reduction to hydrogen generation is 1.08 V. The hydrogen peroxide production ratio is from 2 to 15%.

COMPARATIVE EXAMPLE 4

Except that the electrode activity test is carried out with an electrode which uses carbon containing no nitrogen (KetjenBlack (registered trademark) EC300J) instead of the carbon alloy catalyst as a catalyst, it is the same as in Example 2.

The oxygen reduction initiation potential is about 0.93 V vs. RHE in Comparative Example 4. The hydrogen generation initiation potential is −0.58 V vs. RHE. The operative potential window from the oxygen reduction to hydrogen generation is 1.41 V. The hydrogen peroxide production ratio is from 50 to 100%. It was found that the operative potential window is similar to that in Example 2 but the hydrogen peroxide production ratio is very high. As such, it was found that it is the carbon alloy catalyst of an embodiment of the invention containing nitrogen which has a sufficient activity of reducing oxygen to water.

The carbon alloy catalyst used as a catalyst for reducing oxygen of an embodiment of the invention is not limited to the materials indicated in Example 1 and 2. Examples of the carbon precursor containing nitrogen include a nitrogen-containing phenol resin, an imide resin, a melamine resin, a benzoguanamine resin, and the like. Examples of the metallic compound include iron phthalocyanine, cobalt phthalocyanine, iron sulfate, cobalt sulfate, iron chloride, cobalt chloride, cobalt sulfate, iron nitrate, potassium hexacyanoferrate, cobalt nitrate, and cobalt acetate. These materials were mixed with 8 g of each resin, 1 g of a metal precursor, and 5 g of KetjenBlack (registered trademark) EC300J as a carrier in 150 ml of THF (tetrahydrofuran). After mixing, the mixture was refluxed for 2 hours at 80° C. while being stirred at 300 rpm using a stirrer. The solution obtained after reflux was dried by an evaporator using a hot-water bath at 45° C., and the dried product was calcined for an hour at 800° C. under argon atmosphere. After calcination, the calcined product was washed with 2 M hydrochloric acid to give various carbon alloy catalysts. The catalysts produced were found to have nitrogen substitution ratio of ~10% in the surface according to XPS.

The oxidation reduction characteristics were evaluated after producing an electrode using the catalyst in the same manner as in the first embodiment of the invention. It was found that the oxygen reduction initiation potential in an acidic electrolysis liquid is about from 0.88 to 0.75 V vs. RHE. The hydrogen generation potential is −0.2 to −0.7 V vs. RHE. The oxygen reduction initiation potential in an alkali neutral electrolysis liquid is about 0.94 to 0.87 V vs. RHE. The hydrogen generation potential is −0.2 to −0.9 V vs. RHE. The hydrogen peroxide production ratio is from 1 to 50%.

EXAMPLE 3

The electrolysis device 10-1 shown in the conceptual diagram of FIG. 3 was produced and an electrolysis test was carried out. As an anode of Example 3, titanium mesh (0.1 t×LW 0.2×SW 0.1) obtained by etching in advance for 1 hour at 80° C. with 10 wt % aqueous solution of oxalic acid was coated with a solution prepared by adding 1-butanol to iridium chloride ($IrCl_3.nH_2O$) to have 0.25 M (Ir). After that, it was dried (10 min, 80° C.) and calcined (10 min, 450° C.). Coating-drying-calcination was repeated five times to produce the anode.

As a cathode of Example 3, 60 mg of the catalyst obtained from Example 1 was dispersed in 50 cc of water. The liquid was suspended under being boiled and stirred. The suspension obtained was applied onto a carbon paper (trade name: TPG-H-090, manufactured by Toray Industries, Inc., thickness of 0.28 mm and area of 12 $cm^2$) which has been subjected to water repellency treatment (20 wt %), and absorption filtration was repeated at 0.09 MPa until the filtrate becomes transparent followed by drying. To the dried product, 2 wt % Nafion (registered trademark) solution dissolved in ethanol was added by dropwise addition under reduced pressure (0.09 MPa), and then immersed in 4 wt % Nafion (registered trademark) solution dissolved in ethanol. The resultant obtained after immersion was boiled in pure water for 1 hour to give a cathode.

As for the membrane electrode assembly of Example 3, the anode and the cathode produced were added into each side of a polymer electrolysis liquid Nafion (registered trademark) 112 (50 μm), and subjected to hot-press at 125° C. and 0.36 MPa for 5 min to give a membrane electrode assembly.

To an electrolysis cell that is produced by attaching the water supply tube 15, the water discharge tube 16, the air supply tube 17, and the air discharge tube 18 to the membrane electrode assembly above, external DC voltage is applied, and flowing current (A), flow amount (1 CCM=$1.667\times10^{-8}$ $m^3/s$), and the oxygen concentration (vol %) in the air supply tube 17 and the air discharge tube 18 were measured.

When the air amount in the air supply tube 17 is 100 CCM (oxygen 21%), the air in the air discharge tube 18 was 96.5 CCM and the oxygen concentration was 18.1% at application current of 1 A. The air in the air discharge tube 18 was 93 CCM and the oxygen concentration was 15.1% at application current of 2 A. All the results are almost the same as the theoretical values and no hydrogen generation was observed. Further, occurrence of water on the surface of the cathode was identified while voltage is being applied.

COMPARATIVE EXAMPLE 5

Except that Pt/C is used as a catalyst for the cathode, it is the same as in Example 3.

When the air amount in the air supply tube 17 is 100 CCM (oxygen 21%), the air in the air discharge tube 18 was 96.5 CCM and the oxygen concentration was 18.1% at application current of 1 A. The air in the air discharge tube 18 was 93 CCM and the oxygen concentration was 15.1% at application current of 2 A. As the catalyst of Comparative Example 5 uses Pt/C, it was estimated that the hydrogen generation ratio is 1 to 50% at application voltage of 1.7 V. Thus, in Comparative Example 5, the oxygen reduction did not occur as much amount as that of the hydrogen generation and also wasteful power consumption is caused.

EXAMPLE 4

By attaching the membrane electrode assembly which has been produced in Example 3 to an openable sealing vessel as in the oxygen reduction device 20-3 of FIG. 7, an oxygen reduction device was produced. When electric current is allowed to flow from the power source 11 attached to the membrane electrode assembly, oxygen concentration was decreased in accordance with the electric current, as theoretically expected. Specifically, decrease in the concentration from about 20% to about 5% was identified. Hydrogen generation was not observed even when the voltage applied to the membrane electrode assembly was changed to 1.7 V.

COMPARATIVE EXAMPLE 6

Except that Pt/C is used as a catalyst for a cathode, it is the same as in Example 4. When electric current is allowed to flow from the power source 11 attached to the membrane electrode assembly, oxygen concentration was decreased. However, when the voltage applied to the membrane electrode assembly was changed to 1.7 V, 1 to 20% of the reaction at the cathode was a reaction to generate hydrogen.

Comparing Example 4 to Comparative Example 6, a difference in the ability of suppressing hydrogen generation was found at an actual device level. Specifically, in Comparative Example 6, the oxygen reduction did not occur as much amount as that of the hydrogen generation and also wasteful power consumption is caused.

EXAMPLE 5

By attaching the oxygen reduction device of Example 4 to a refrigerator, a space having reduced oxygen can be included in a refrigerator, for example. It was confirmed that, by running the oxygen reduction device, the oxygen concentration was decreased in accordance with the electric current, as theoretically expected, i.e., from about 21% to about 10%. Because the internal oxygen concentration can be lowered by closing the refrigerator door, corrosion due to oxidation is suppressed, and as a result storage life of foods can be extended.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An operation method of an electrolysis device, the electrolysis device comprising an anode, a cathode having a nitrogen-containing carbon alloy catalyst, and an electrolysis cell having a membrane electrode assembly composed of an electrolyte present between the anode and the cathode, having a nitrogen-containing carbon alloy catalyst, the method comprising:

applying voltage to the anode and the cathode having a nitrogen-containing carbon alloy catalyst, wherein:

the electrolyte is any one of acidic, neutral, or alkali;

a potential at the cathode having a nitrogen-containing carbon alloy catalyst is lower than a hydrogen generation potential at a cathode in which Pt is used as a catalyst;

the device is operated with a condition of that a hydrogen generation potential at the cathode having a nitrogen-containing carbon alloy catalyst, is −0.2 to −0.7 V vs. RHE when the electrolyte is acidic or that a hydrogen generation potential at the cathode having a nitrogen-containing carbon alloy catalyst, is −0.2 to −0.9 V vs. RHE when the electrolyte is neutral or alkali; and the device is operated with a condition of that an oxygen reduction initiation potential at the cathode having a nitrogen-containing carbon alloy catalyst is 0.88 to 0.75 V vs. RHE when the electrolyte is acidic or that an oxygen reduction initiation potential at the cathode having a nitrogen-containing carbon alloy catalyst is 0.94 to 0.87 V vs. RHE when the electrolyte is neutral or alkali.

2. The method according to claim 1, wherein the electrolyte of the membrane electrode assembly is an acidic membrane having cation exchange ability.

3. The method according to claim 1, wherein the electrolyte of the membrane electrode assembly is a neutral or alkali membrane having anion exchange ability.

4. The method according to claim 1, wherein the electrolysis cell is provided in a sealable vessel.

5. The method according to claim 1, wherein, compared to amount of elements on surface, 0.1 atm % or more to 30 atm % or less of the carbon in the carbon alloy catalyst is substituted with nitrogen.

6. The method according to claim 1, wherein, compared to amount of elements on surface, 0.1 atm % or more to 10 atm % or less of the carbon in the carbon alloy catalyst is substituted with nitrogen.

7. The method according to claim 1, wherein a part of the carbons forming Sp2 hybrid orbital with each other in the carbon alloy catalyst is substituted with nitrogen.

8. The method according to claim 1, wherein the carbon alloy catalyst has a pyridine type nitrogen substitution.

9. The method according to claim 1, wherein the carbon alloy catalyst has a pyrrole·substitution, a pyridone substitution or a combination of two.

10. The method according to claim 1, wherein the carbon alloy catalyst has an N oxide type nitrogen substitution.

11. The method according to claim 1, wherein the carbon alloy catalyst has a pore and 60% or more of the pore has a diameter of 20 nm or more.

12. The method according to claim 1, wherein the carbon alloy catalyst has a specific surface area of 100 $m^2/g$ to 1200 $m^2/g$.

13. An operation method of a refrigerator device, the method comprising:

applying voltage to an anode and a cathode, having a nitrogen-containing carbon alloy catalyst, wherein:

the refrigerator device comprises an electrolysis device comprising the anode, the cathode having a nitrogen-containing carbon alloy catalyst, and an electrolysis cell having a membrane electrode assembly composed of an electrolyte present between the anode and the cathode having a nitrogen-containing carbon alloy catalyst;

the electrolyte is any one of acidic, neutral, or alkali;

a potential at the cathode having a nitrogen-containing carbon alloy catalyst is lower than a hydrogen generation potential at a cathode in which Pt is used as a catalyst;

the electrolysis device is operated with a condition of that a hydrogen generation potential at the cathode is −0.2 to −0.7 V vs. RHE when the electrolyte is acidic or that a hydrogen generation potential at the cathode having a nitrogen-containing carbon alloy catalyst is −0.2 to −0.9 V vs. RHE when the electrolyte is neutral or alkali; and the electrolysis device is operated with a condition of that an oxygen reduction initiation potential at the cathode having a nitrogen-containing carbon alloy catalyst is 0.88 to 0.75 V vs. RHE when the electrolyte is acidic or that an oxygen reduction initiation potential at the cathode having a nitrogen-containing carbon alloy catalyst is 0.94 to 0.87V vs. RHE when the electrolyte is neutral or alkali.

14. The method according to claim 13, wherein the electrolyte of the membrane electrode assembly is an acidic membrane having cation exchange ability.

15. The method according to claim 13, wherein the electrolyte of the membrane electrode assembly is a neutral or alkali membrane having anion exchange ability.

16. The method according to claim 13, wherein the electrolysis cell is provided in a sealable vessel.

17. The method according to claim 13, wherein, compared to amount of elements on surface, 0.1 atm % or more to 30 atm % or less of the carbon in the carbon alloy catalyst is substituted with nitrogen.

18. The method according to claim 13, wherein, compared to amount of elements on surface, 0.1 atm % or more to 10 atm % or less of the carbon in the carbon alloy catalyst is substituted with nitrogen.

19. The method according to claim 13, wherein a part of the carbons forming Sp2 hybrid orbital with each other in the carbon alloy catalyst is substituted with nitrogen.

20. The method according to claim 13, wherein the carbon alloy catalyst has a pyridine type nitrogen substitution.

21. The method according to claim 13, wherein the carbon alloy catalyst has a pyrrole·substitution, a pyridone substitution or a combination of the two.

22. The method according to claim 13, wherein the carbon alloy catalyst has an N oxide type nitrogen substitution.

23. The method according to claim 13, wherein the carbon alloy catalyst has a pore and 60% or more of the pore has a diameter of 20 nm or more.

24. The method according to claim 13, wherein the carbon alloy catalyst has a specific surface area of 100 $m^2/g$ to 1200 $m^2/g$.

* * * * *